US008627991B2

(12) United States Patent
Francis et al.

(10) Patent No.: US 8,627,991 B2
(45) **Date of Patent: *Jan. 14, 2014**

(54) FASTENING TOOL WITH BLIND GUIDE WORK CONTACT TIP

(71) Applicant: Illinois Tool Works Inc., Glenview, IL (US)

(72) Inventors: Ryan L. Francis, Palatine, IL (US); James L. Kuhnwald, Richmond, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/782,602

(22) Filed: Mar. 1, 2013

(65) Prior Publication Data

US 2013/0175314 A1 Jul. 11, 2013

Related U.S. Application Data

(62) Division of application No. 12/793,397, filed on Jun. 3, 2010, now Pat. No. 8,387,846.

(51) Int. Cl.

| | |
|---|---|
| ***B25C 5/02*** | (2006.01) |
| ***B25C 5/06*** | (2006.01) |
| ***B25C 7/00*** | (2006.01) |

(52) U.S. Cl.
USPC ..... 227/148; 227/156

(58) Field of Classification Search
USPC ..... 227/156, 148; 173/107–155
See application file for complete search history.

(56) References Cited

U.S. PATENT DOCUMENTS

| | | | |
|---|---|---|---|
| 2,169,433 | A | 8/1939 | Roy |
| 2,374,558 | A | 4/1945 | Moore |
| 2,701,491 | A | 2/1955 | Ross |
| 2,723,694 | A | 11/1955 | Ross |
| 2,743,444 | A | 11/1956 | Thomas |

(Continued)

FOREIGN PATENT DOCUMENTS

| | | |
|---|---|---|
| CN | 2855655 Y | 1/2007 |
| DE | 4132504 | 4/1992 |

(Continued)

OTHER PUBLICATIONS

International Search Report for PCT/US2010/037587 dated Sep. 10, 2010.

(Continued)

*Primary Examiner* — Robert Long

(57) ABSTRACT

A blind guide work contact tip for mounting to a drive probe of a fastening tool is shaped in a manner which allows for an angled nail placement, such as 45 degree into a workpiece. The blind guide work contact is a one-piece attachment which is fitted around the existing drive probe and includes a body and two wings which extend therefrom forming a channel through which a fastener passes into the workpiece. The body has a work surface with a peak and sloped slides adjacent each side of the peak at approximately 45 degrees. The sloped surfaces allows the blind guide work contact tip to better access corners and angled spaces than previous work contact tips. The work contact tip also has a flat portion at the peak of the work surface so as to not inhibit face nailing.

5 Claims, 5 Drawing Sheets

Fig. 4

(56) References Cited

U.S. PATENT DOCUMENTS

| | | | | |
|---|---|---|---|---|
| 2,782,822 | A | 2/1957 | Clark | |
| 2,822,544 | A | 2/1958 | Anstett | |
| 2,866,199 | A | 12/1958 | Freeman | |
| 2,929,067 | A | 3/1960 | Tupta | |
| 3,012,247 | A | 12/1961 | Sillars | |
| 3,025,734 | A | 3/1962 | Ash | |
| 3,272,267 | A | 9/1966 | Langas | |
| 3,281,046 | A | 10/1966 | Boulay | |
| 3,563,438 | A | 2/1971 | Doyle et al. | |
| 3,587,683 | A | 6/1971 | Bangerter | |
| 3,653,299 | A | 4/1972 | Howard | |
| 3,739,825 | A | 6/1973 | Knox | |
| 3,796,270 | A | 3/1974 | Lange | |
| 3,815,627 | A | 6/1974 | Farrell et al. | |
| 3,828,458 | A | 8/1974 | Skone-Palmer | |
| 3,847,193 | A | 11/1974 | Brunstetter | |
| 3,960,191 | A | 6/1976 | Murray | |
| 3,965,950 | A | 6/1976 | MacDonald | |
| 3,973,605 | A | 8/1976 | DeCaro | |
| 4,122,904 | A | 10/1978 | Haytayan | |
| 4,132,504 | A * | 1/1979 | Fitch | 417/68 |
| 4,196,833 | A | 4/1980 | Haytayan | |
| 4,236,555 | A | 12/1980 | Dewey | |
| 4,309,805 | A * | 1/1982 | Jacobson | 29/429 |
| 4,346,831 | A | 8/1982 | Haytayan | |
| 4,375,867 | A | 3/1983 | Novak et al. | |
| 4,385,297 | A | 5/1983 | Schmitt et al. | |
| 4,403,725 | A | 9/1983 | Lawrence | |
| 4,448,338 | A | 5/1984 | Graf et al. | |
| 4,485,701 | A | 12/1984 | Hough | |
| 4,509,669 | A | 4/1985 | Elliesen | |
| 4,566,619 | A * | 1/1986 | Kleinholz | 227/8 |
| 4,581,964 | A * | 4/1986 | Takatsuru | 81/464 |
| 4,691,598 | A | 9/1987 | Lin | |
| 4,697,992 | A | 10/1987 | Hatakeyama | |
| 4,760,763 | A | 8/1988 | Trick et al. | |
| 4,767,043 | A | 8/1988 | Canlas, Jr. | |
| 4,869,008 | A | 9/1989 | Rasmussen | |
| 4,932,313 | A | 6/1990 | Gutknecht | |
| 5,083,694 | A | 1/1992 | Lemos | |
| 5,133,329 | A | 7/1992 | Rodseth et al. | |
| 5,261,587 | A * | 11/1993 | Robinson | 227/8 |
| 5,279,188 | A | 1/1994 | Seeger et al. | |
| 5,410,942 | A | 5/1995 | Begneu | |
| 5,415,136 | A | 5/1995 | Doherty et al. | |
| 5,649,661 | A * | 7/1997 | Masuno et al. | 227/8 |
| 5,810,239 | A * | 9/1998 | Stich | 227/119 |
| 5,839,638 | A * | 11/1998 | Ronn | 227/8 |
| 5,996,874 | A | 12/1999 | Fukishima et al. | |
| 6,012,622 | A | 1/2000 | Weinger et al. | |
| 6,032,848 | A | 3/2000 | Smolinski | |
| 6,095,392 | A * | 8/2000 | Batts et al. | 227/8 |
| 6,186,386 | B1 | 2/2001 | Canlas et al. | |
| 6,189,759 | B1 | 2/2001 | Canlas et al. | |
| 6,220,122 | B1 | 4/2001 | Forsell et al. | |
| 6,286,742 | B1 * | 9/2001 | Mukoyama | 227/8 |
| 6,318,620 | B1 | 11/2001 | Anstett et al. | |
| 6,371,348 | B1 | 4/2002 | Canlas et al. | |
| 6,394,268 | B1 | 5/2002 | Dill et al. | |
| 6,481,612 | B1 * | 11/2002 | Mangone, Jr. | 227/130 |
| 6,581,815 | B1 | 6/2003 | Ho et al. | |
| 6,631,836 | B2 | 10/2003 | Dickhaut | |
| 6,679,415 | B1 | 1/2004 | Gupta | |
| 6,712,256 | B1 | 3/2004 | Curry | |
| 6,722,547 | B1 | 4/2004 | Wang et al. | |
| 6,729,522 | B2 | 5/2004 | Hempfling et al. | |
| 6,783,045 | B2 | 8/2004 | Shima et al. | |
| 6,824,036 | B2 | 11/2004 | Walter | |
| 6,837,415 | B1 | 1/2005 | Huang | |
| 6,843,402 | B2 | 1/2005 | Sims et al. | |
| 7,051,914 | B2 | 5/2006 | Herelier | |
| 7,070,079 | B2 * | 7/2006 | Smolinski et al. | 227/8 |
| 7,086,573 | B1 | 8/2006 | Wen | |
| 7,108,164 | B2 | 9/2006 | Shima et al. | |
| 7,124,837 | B2 | 10/2006 | Martin et al. | |
| 7,134,586 | B2 | 11/2006 | McGee et al. | |
| 7,150,384 | B2 | 12/2006 | Yasuike et al. | |
| 7,163,134 | B2 | 1/2007 | Moeller et al. | |
| 7,228,917 | B2 | 6/2007 | Davis et al. | |
| 7,255,256 | B2 * | 8/2007 | McGee et al. | 227/8 |
| 7,303,105 | B2 | 12/2007 | Dion et al. | |
| 7,306,052 | B2 | 12/2007 | Vahabi-Nejad et al. | |
| 7,341,172 | B2 | 3/2008 | Moore et al. | |
| 7,344,057 | B2 | 3/2008 | Dion et al. | |
| 7,419,078 | B2 | 9/2008 | Hamar | |
| 7,427,008 | B2 | 9/2008 | Brendel et al. | |
| 7,516,876 | B2 * | 4/2009 | Ohmori | 227/119 |
| 7,565,992 | B2 | 7/2009 | Buetow | |
| 7,677,425 | B2 | 3/2010 | Brendel et al. | |
| 7,690,546 | B2 | 4/2010 | Cortez | |
| 7,721,817 | B2 | 5/2010 | McGee et al. | |
| 7,753,243 | B2 | 7/2010 | Brendel et al. | |
| 7,757,920 | B2 | 7/2010 | Shea et al. | |
| 7,802,500 | B2 | 9/2010 | Kolodziej et al. | |
| 7,926,141 | B2 * | 4/2011 | Dayton et al. | 15/23 |
| 7,980,439 | B2 | 7/2011 | Akiba et al. | |
| 7,988,025 | B2 * | 8/2011 | Terrell | 227/119 |
| 8,056,785 | B2 * | 11/2011 | Gosis et al. | 227/19 |
| 8,104,658 | B2 | 1/2012 | Yu | |
| 8,235,270 | B2 * | 8/2012 | Gosis et al. | 227/19 |
| 8,292,143 | B2 | 10/2012 | Lee et al. | |
| 8,387,846 | B2 * | 3/2013 | Francis et al. | 227/148 |
| 2001/0038026 | A1 | 11/2001 | Dickhaut | |
| 2003/0002929 | A1 * | 1/2003 | Nagashima | 407/40 |
| 2003/0024962 | A1 * | 2/2003 | Sims et al. | 227/148 |
| 2003/0041704 | A1 * | 3/2003 | Pelt | 81/466 |
| 2005/0145670 | A1 | 7/2005 | Huang | |
| 2005/0194421 | A1 | 9/2005 | Smolinski et al. | |
| 2007/0074882 | A1 | 4/2007 | Davis et al. | |
| 2007/0108249 | A1 | 5/2007 | Moeller | |
| 2007/0215665 | A1 | 9/2007 | Ohmori | |
| 2007/0215668 | A1 * | 9/2007 | Tabacco et al. | 227/107 |
| 2008/0190988 | A1 | 8/2008 | Pedicini et al. | |
| 2008/0296341 | A1 * | 12/2008 | Francescon | 227/119 |
| 2009/0072005 | A1 | 3/2009 | Cortez | |
| 2009/0266867 | A1 * | 10/2009 | Mina et al. | 227/151 |
| 2010/0084451 | A1 * | 4/2010 | Abla | 227/107 |

FOREIGN PATENT DOCUMENTS

| | | | | |
|---|---|---|---|---|
| DE | 4132504 | A1 * | 4/1992 | B25F 3/00 |
| DE | 9209745 | | 9/1992 | |
| EP | 0338554 | | 10/1989 | |
| EP | 0386878 | | 1/1991 | |
| FR | 2613266 | A1 | 10/1988 | |
| FR | 2712224 | A1 | 5/1995 | |
| JP | 202273671 | | 9/2002 | |
| TW | 225175 | | 6/1994 | |
| TW | 417574 | U | 1/2001 | |
| TW | 592909 | | 6/2004 | |
| TW | M250773 | U | 11/2004 | |

OTHER PUBLICATIONS

International Search Report for PCT/US2007/0060101 dated Oct. 11, 2007.

"Duo-Fast, Nailers Staplers, Fasteners, Safety, Operation & Instruction Manual, Pneumatic Fastening Systems" 2000, Duo-Fast Corporation Form No. Manual Pneumatic, Nov. 2000.

* cited by examiner

FASTENING TOOL WITH BLIND GUIDE WORK CONTACT TIP

BACKGROUND OF THE INVENTION

The present invention relates generally to fastening tools and, more particularly, to a fastening tool that has a guide for blind fastener placement into a corner or angled spaced.

Fastening tools typically include a drive probe for contacting a workpiece and for enabling the firing of the tool, see for example U.S. Pat. No. 6,012,622, assigned to the assignee of this application. U.S. Pat. No. 4,767,043 discloses a work-contacting block connected to a guide rod. U.S. Pat. No. 6,371,348 discloses a work contact element connected to a lower structure or metal rod. However, work contact elements have been so large or obstructive of the view of the workpiece that they make it difficult to determine where a fastener will be driven. The issue is even more apparent when attempting to put a fastener into a corner or angle. The corner or angle makes inserting a fastener into the corner or angled space even more difficult.

Some work contact elements mar the surface of the workpiece. Imprecision and marring are problems when driving fasteners into trim or molding for finishing applications, wherein appearance is important. No mar tips have been fashioned that wrap over the work contact element to prevent marring of the workpiece surface. However, these no-mar tips still do not address the problems associated with inserting a fastener into a corner or angle. Hardwood installations typically require blind and face nailing of the first few rows of flooring. Installers typically use 15 gauge or 16 gauge straight or angled nailers, such as finish nailers for these applications. Conventional work contact elements and no-mar tips hinder line of sight for 45 degree blind nailing.

Accordingly, there is a need for a type of work contact element for a fastening tool that is of convenient size and shape to enable proper placement of a fastener into an angled or corner area while not marring the surface of the workpiece and while minimizing the loss of visibility of the work area.

BRIEF SUMMARY OF THE INVENTION

A novel nailing or blind guide work contact tip for mounting to a drive probe of a fastening tool for driving a fastener into a corner or angled portion of a workpiece is provided. The blind guide work contact tip is shaped in a manner which allows for an angle, such as 45 degree, nail placement into, for example, the tongue portion of a floor board, and also has a flat portion at the bottom edge to facilitate, and/or to not inhibit, face nailing.

The blind guide work contact tip has a body which has a front side, a rear side opposite the front side, a work contact surface, and a trailing surface opposite the work contact surface. The work contact surface is generally triangular or trapezoidal in shape, having a flat or curved peak, a first sloped side, and a second sloped side. A pair of wings is integral with opposing lateral ends of the front side of the body. The pair of wings has resilient contact surfaces for contacting the workpiece and form a channel through which a fastener may pass. The blind guide work contact also has a recess or cavity located in the trailing surface of the body for retaining the drive probe of the fastening tool. The recess is generally U-shaped to complement and receive the U-shape of the drive probe.

A detent in the recess retains the drive probe in the recess. The detent includes a ramp for allowing the drive probe to slide along the ramp into the recess. Ends of the recess adjacent the trailing surface include chamfers to allow the work contact tip to pivot in a side-to-side manner with respect to the drive probe so that the tool can be used in tight spaces, such as corners, where the tool cannot be oriented completely vertically. The recess also has chamfered ends that allow the blind guide work contact tip to pivot during operation with respect to the drive probe.

The body has a thickness that is between 55% and about 65% of a total length of the work contact tip and a width that is essentially the entire width of the blind guide work contact tip. The wings include work contact surfaces for contacting the workpiece, trailing surfaces facing generally opposite the contact surfaces, rear ends connected to the body, front ends opposite the rear ends, outside surfaces, and inside surfaces.

The channel formed by the wings and the front of the body of the blind guide work contact tip is configured to receive a nose of the fastening tool. The wings have a predetermined length or space between the front ends. The length of the wings is between about 35% and about 45% of a total length of the work contact tip. A length between the wing front ends and a fastener position is between about 15% and about 25% of the total length of the work contact tip and between about 45% and about 55% of the length of the wings. Each wing has a thickness or width of between about 25% and about 35% of a total width of the blind guide work contact tip, such that the channel has a width of between about 40% and about 50% of the total width of the blind guide work contact tip.

In an example, the blind guide work contact tip has a width of between about 0.6 inch and about 0.8 inch, a length of between about 0.75 inch and about 0.95 inch, and a height of between about 0.5 inch and about 0.7 inch. The body has a thickness of between about 0.4 inch and about 0.6 inch, the wings have a length of between about ¼ inch and about 0.45 inch, and a thickness of between about 0.1 inch and about 0.3 inch. In such a contact tip, a length between the wing front ends and a desired fastener position is between about 0.1 inch and about 0.3 inch.

A fastening tool is also provided incorporating the blind work contact tip thereon. The fastening tool has a driver blade for driving a fastener into a workpiece, a power source for driving the driver blade, and a housing enclosing the driver blade. The housing includes a nosepiece for accepting the fastener and for axially guiding the driver blade in a driving direction toward impact with the fastener. A wire drive probe extends in the driving direction from the housing to a driving end and the resilient blind guide work contact tip is mounted to the driving end of the drive probe.

These and other features and advantages of the present invention will be apparent from the following detailed description, in conjunction with the appended claims.

BRIEF DESCRIPTION OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
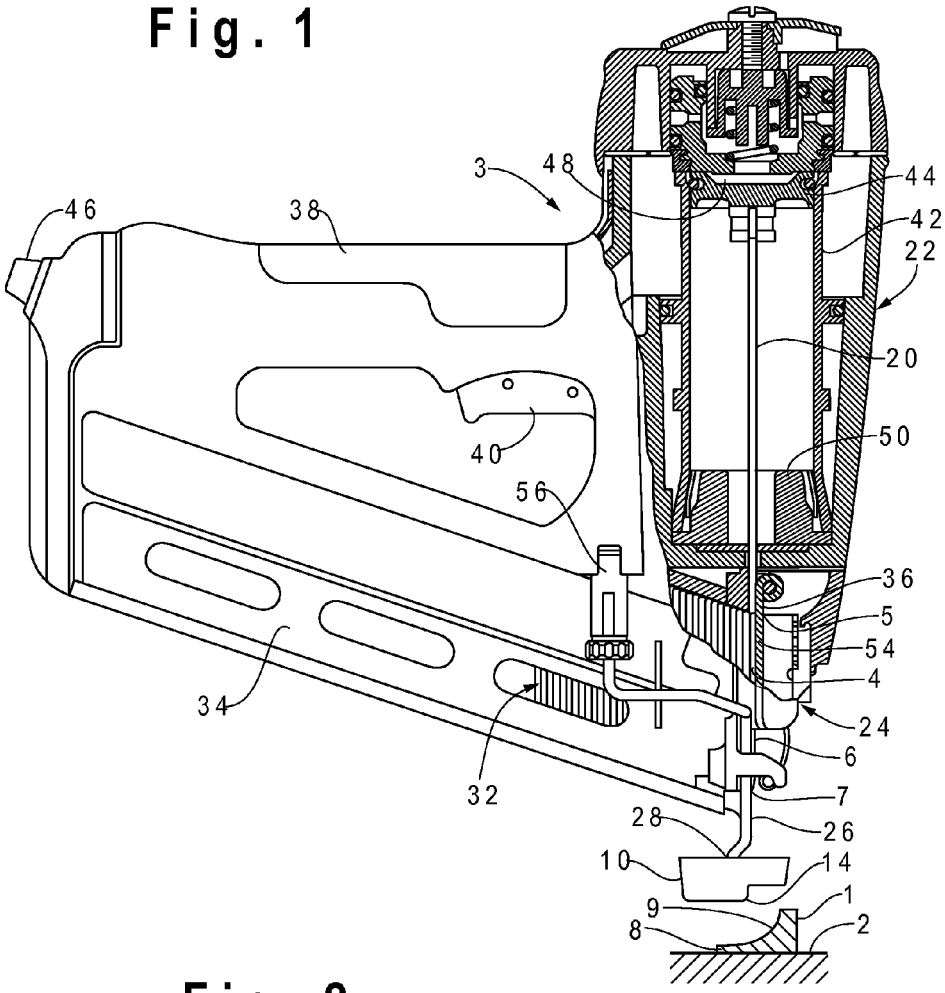
FIG. 1 is partial side sectional view of a tool having a blind guide work contact in accordance with the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Figure 2:
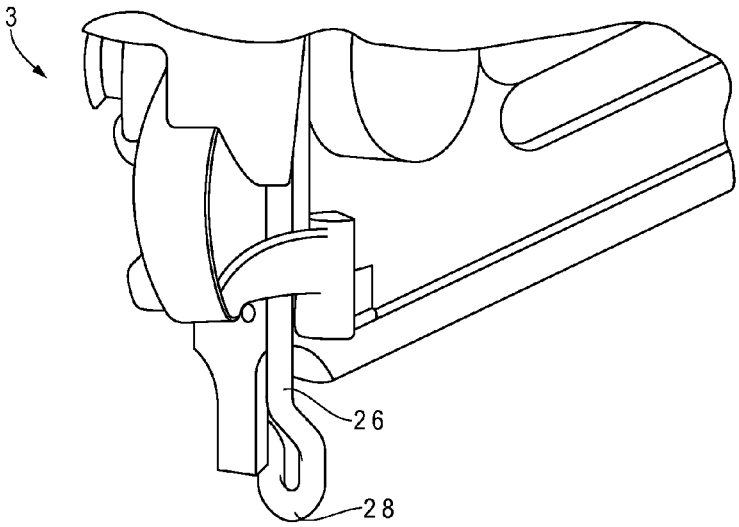
FIG. 2 is an enlarged, perspective view of the driving probe of the tool.

A fastening tool 3, in conjunction with an blind guide work contact tip or no-mar tip 10 that mounts to a driving probe 26 of the fastening tool 3, is used to insert or drive fasteners into corners or angled areas. In FIG. 1, the fastening tool 3 includes a driver blade 20 for driving a fastener 4 into workpiece 1. A power source, such as compressed air, drives driver blade 20 which is housed in housing 22. Housing 22 has a nosepiece 24 for accepting fastener 4 and for axially guiding driver blade 20 in a driving direction toward impact with fastener 4. A wire drive probe 26 extends in the driving direction from housing 22 to a driving end 28. A resilient, angled blind guide work contact tip 10 is mounted to the driving end 28 of drive probe 26 (the drive probe 26 shown in FIG. 2 without the blind guide work tip 10 attached).

In a preferred embodiment, tool 3 is used for driving pins 4 for fastening a workpiece 1, such as molding or trim having a detent 8 as shown in FIG. 1, to a substrate 2, such as a wall or a cabinet. Fasteners 4 may be rectangular or round. In a preferred embodiment particularly suited for trim applications, each fastener 4 has a generally rectangular cross section corresponding generally to the cross section of driver blade 20. Each fastener 4 has a generally rectangular head 5, a generally rectangular shaft 6 and a point 7. A plurality of fasteners 4 can be coupled together in a strip 32 and placed in a magazine 34 of tool 3, as shown in FIG. 1.

Figure 3:
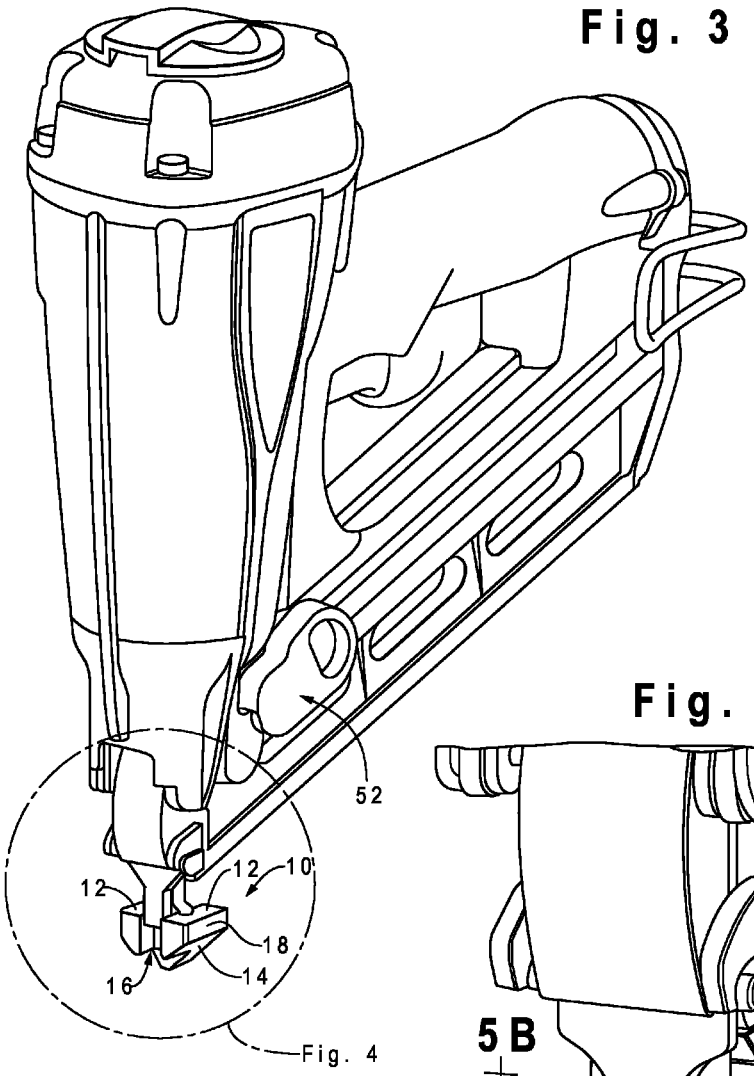
FIG. 3 is a perspective view of the blind guide work contact tip mounted to the drive probe of FIG. 2.
Figure 4:
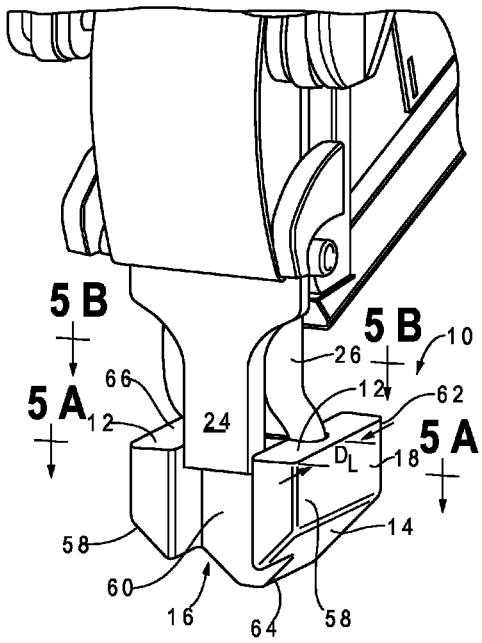
FIG. 4 is an enlarged perspective view of the blind guide work contact tip and the drive probe.

The fastener 4 that is to be driven by driver blade 20 is positioned within a channel 36 within nosepiece 24. Channel 36 acts to guide driver blade 20 and fastener 4 in the driving direction toward workpiece 1. A nose is located at the driving end of nosepiece 24, wherein the nose fits within channel 16 of blind guide work contact tip 10, as shown in FIGS. 3 and 4, so that as driver blade 20 drives fastener 4, driver blade 20 remains within the nose.

Housing 22 of tool 3 includes a handle 38 depending generally from a trailing end of housing 22 for an operator to hold tool 3. A trigger 40 is mounted to handle 38 for actuating tool 3. A cylinder 42 is located within housing 22, with a piston 44 being within cylinder 42. Driver blade 20 is coupled to piston 44 so that when piston 44 is driven in a driving direction through cylinder 42, so is driver blade 20.

A power source, such as pneumatic power, gas combustion, or explosive powder is used to drive piston 44 and driver blade 20 in the driving direction toward fastener 4. In one embodiment, tool 3 includes an air connection 46 for connecting to a compressed air source (not shown), which feeds into a chamber 48 in the trailing direction of piston 44. When trigger 40 is pulled by an operator, air pressure is increased in chamber 48, which drives piston 44 toward fastener 4. Tool 3 can also include a buffer 50 generally at the driving end of cylinder 42 to protect piston 44 and tool 3 from damage due to high speed impact.

Preferably, tool 3 includes a magazine 34 for feeding a strip 32 of fasteners 4 into channel 36. Tool 3 can also include a follower 52 which biases strip 32 toward channel 36, so that when one fastener 4 is driven, the follower biases the next fastener 4 into channel 36. Tool 3 also includes a front plate 54, which frames part of channel 36, and preferably can be temporarily removed, such as by the hinged connection to housing 22 shown in FIG. 1, so that channel 36 can be opened to perform maintenance, such as removing debris from channel 36.

Continuing with FIG. 1, tool 3 also includes drive probe 26 extending in the driving direction from housing 22. Drive probe 26 is operationally connected to a triggering mechanism (not shown) via a link 56, so that tool 3 cannot be fired without drive probe 26 and link 56 being pushed in the trailing direction by workpiece 1, enabling actuation of tool 3. In one embodiment, drive probe 26 is generally U-shaped at driving end 28, as seen in FIG. 3. The blind guide work contact tip 10 is mounted to driving end 28 of drive probe 26 to prevent drive probe 26 from marring the surface of workpiece 1.

FIGS. 3-7 depicts an exemplary embodiment of the present blind guide work contact tip 10 for use with the fastening tool 3 described above. In an embodiment, the blind guide work contact tip 10 is a one-piece attachment which is fitted around the existing drive probe 26.

The blind guide work contact tip 10 includes a body 18 having ends 58, a front side 60, a rear side 62, a work contact surface 64, and a trailing surface 66 opposite the work contact surface 64. The blind guide work contact 10 is shaped in a manner which allows, for example, for 45° nail placement into the tongue portion T of the floor board (see FIG. 7), but also contains a peak 15, which is flat or slightly curved, on the work contact surface 64 to not inhibit face nailing. One having skill in the art will appreciate that the blind guide work contact 10 may be shaped at an angle other than 45 degrees, such as between and including 1-89 degrees.

The work contact surface 64 is a generally triangular or trapezoidal-shaped work contact surface 64 with a peak 15 which is flat or gently curved, from which slopes the two resilient side work contact surfaces 14. The side contact surfaces 14 slope at an angle of about 45 degrees from an axis through the peak 15 that is parallel to a plane passing through the trailing surface 66, as shown in FIG. 5C. The wings 12 extend from generally opposite ends 58 of the front side 60 of body 18, as shown in FIG. 4.

Figure 5A:
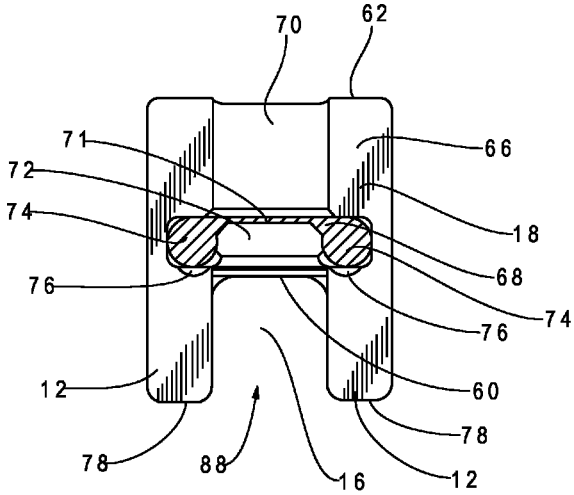
FIGS. 5A-5C are various views of the blind guide work contact tip.

The body 18 also includes means for connecting to drive probe 26, such as a recess 68, shown in FIG. 5A. The means for connecting to drive probe 26 can also be included with one or both of wings 12. The recess 68 is in the trailing surface 66 of body 18 and includes an opening 70 in body 18, for more easily mounting blind guide work contact tip 10 to drive probe 26. Preferably, recess 68 and opening 70 are generally U-shaped to complement the U-shape of drive probe 26. A detent 71 can also be included in recess 68 to retain drive probe 26 in recess 68. In one embodiment, detent 71 includes a ramp 72 for easily mounting to drive probe 26 so that drive probe 26 can slide along ramp 72 into recess 68. In one embodiment, the ends 74 of recess 68 include chamfers 76 to allow blind guide work contact tip 10 to rock or pivot in a side-to-side manner with respect to drive probe 26 so that tool 3 can be used in tight spaces, such as corners, where tool 3 cannot be oriented completely vertically.

Figure 5B:
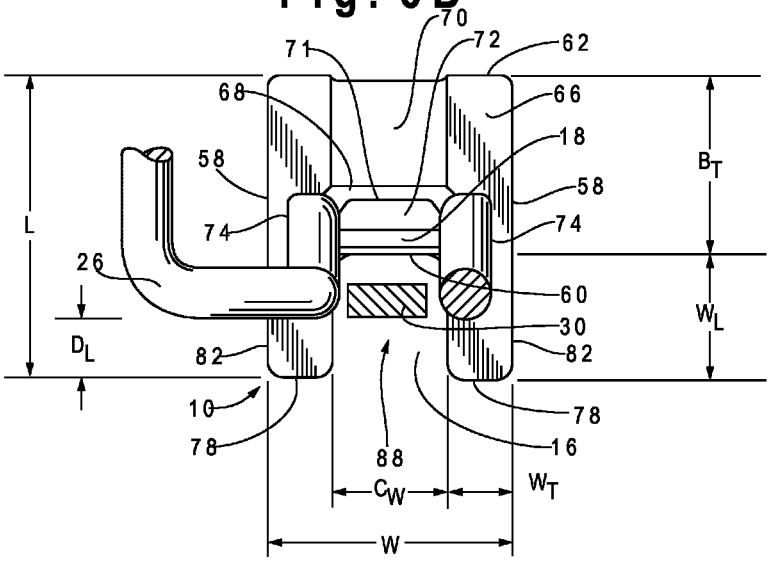
Figure 5C:
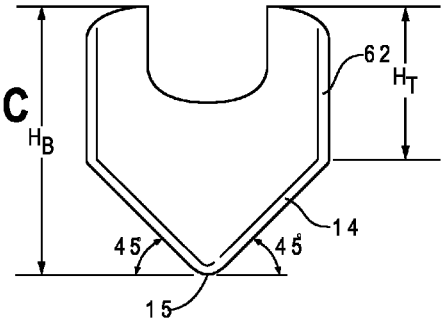
Figure 6:
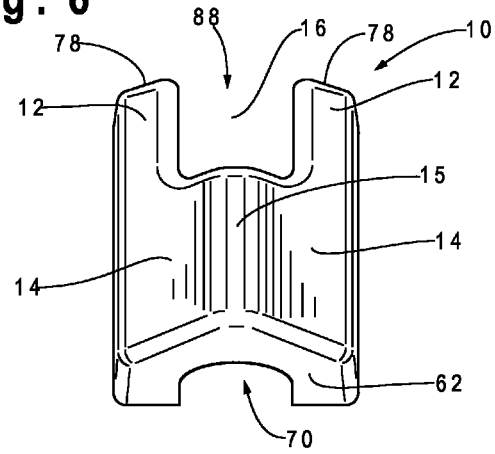
FIG. 6 is a bottom view of the blind guide work contact tip.

The blind guide work contact tip 10 has a cross section that is generally U-shaped, as is best seen in FIGS. 4-6, having a channel 16 surrounding a path for pin 4 and driver blade 20. The wings 12 and front side 60 of the body 18 form the channel 16 for driver blade 20 and fastener 4 while allowing for visually locating the position 30 where fastener 4 will be driven into workpiece 1. The wings 12 are connected to front side 60 of body 18 at ends 58.

Channel 16 allows for visually locating the position 30 where fastener or pin 4 will be driven into workpiece 1, when the angled blind guide work contact tip 10 is mounted to work contact element 25 and drive probe 26. The position 30 where fastener 4 will be driven may be visually located because blind guide work contact tip 10 includes a window 88 between wing ends 78 so that an operator can look into channel 16 and visually determine where fastener 4 will be driven into workpiece 1.

Figure 8:
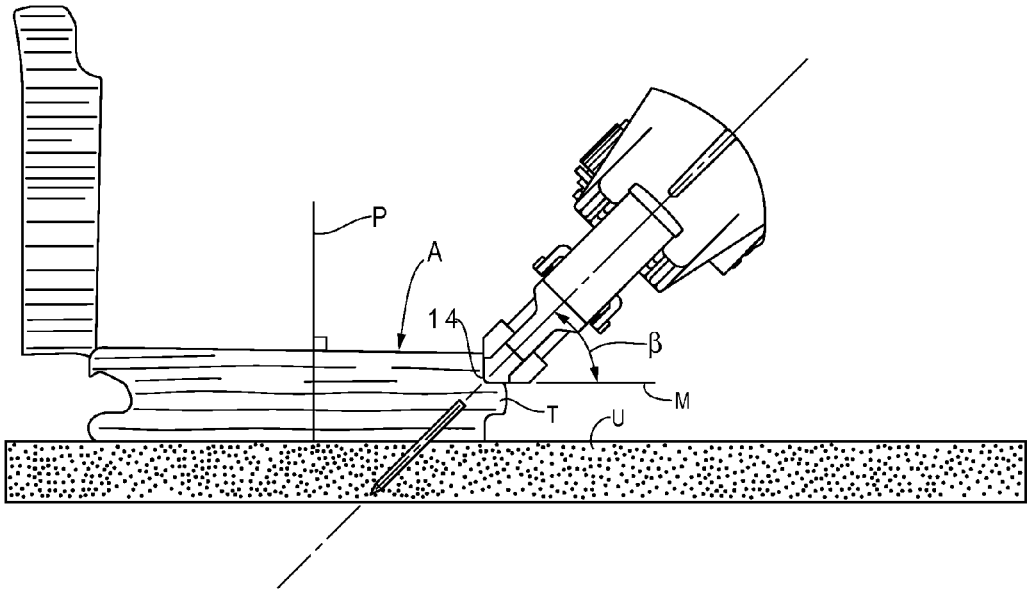
FIG. 8 is an overview of blind nailing.

So that the blind guide work contact tip 10 obstructs as little of workpiece 1 as possible, the wings 12 and the body 18 also may be tapered toward work contact surfaces 14 at an angle of about 45.0 degrees with respect to a line P perpendicular to the workpiece, as shown in FIG. 8.

The blind guide work contact tip 10 can also include indicia to precisely locate the position 30 where fastener 4 will be driven into workpiece 1. Each wing 12 may include an index, preferably on outside surfaces 82, and rear side 62 of body 18. An operator can use wing indicia to precisely located the position 30 of fastener 4 along the length L of blind guide work contact tip 10, and the operator can use rear side indicia to precisely locate the position 30 of fastener 4 along the width W of blind guide work contact tip 10, so that the operator can precisely locate the exact position 30 of fastener 4 before firing tool 3.

The body 18 has a thickness $B_T$ that is between about 45% and about 65%, preferably between about 50% and about 60%, still more preferably about 55% of the total length L of blind guide work contact tip 10. Body 18 also has a width that is essentially the entire width W of blind guide work contact tip 10.

Wings 12 have a predetermined length $W_L$ selected for precision placement of fastener 4 in workpiece 1. Length $W_L$ of wings 12 is selected so that a desired length between front ends 78 of wings 12 and position 30 where fastener 4 will be driven is achieved. The length from front ends 78 of wings 12 to fastener position 30 is selected so that wing ends 78 can be pushed against a surface, such as a wall 9 of a detent shown in FIG. 1, and fastener 4 will be driven close to the surface. The desired length $D_L$ allows an operator to easily place a fastener 4 relative to the surface, by simply pushing wing ends 78 against the surface and actuating tool 3.

The length $W_L$ of wings is between about 30% and about 50%, preferably between about 35% and about 45%, still more preferably about 40% of the total length L of blind guide work contact tip 10. The length $D_L$ between wing ends 78 and fastener position 30 can be between about 10% and about 30%, preferably between about 15% and about 25%, still more preferably about 20% of the total length L of blind guide work contact tip 10, and length $D_L$ can be between about 25% and about 75%, preferably between about 40% and about 60%, still more preferably about 50% of the length $W_L$ of wings 12.

Each wing 12 can have a thickness $W_T$ of between about 15% and about 35%, preferably between about 25% and about 30%, still more preferably about 27% of the total width W of blind guide work contact tip 10, so that channel 16 has a width $C_W$ of between about 30% and about 70%, preferably between about 40% and about 50%, still more preferably about 45% of the total width W of blind guide work contact tip 10.

The wings 12 can have a length $W_L$ of between about ¼ inch and about ½ inch, preferably about 0.35 inch, and wings 12 can each have a thickness of between about 0.1 inch and about 0.3 inch, preferably about 0.2 inch. The length $D_L$ between wing ends 78 and fastener position 30 can be between about 0.05 inch and about 0.35 inch, preferably between about 0.1 inch and about 0.3 inch, still more preferably about 0.2 inch.

Turning to FIG. 5A-5C, the blind guide work contact tip 10 has a width W of between about ½ inch and about 1 inch, preferably between about 0.6 inch and about 0.8 inch, still more preferably about 0.7 inch. Angled blind guide work contact tip 10 has a preferred length L may be between about 0.7 inch and about 1 inch, preferably between about 0.75 inch and about 1.0 inch, still more preferably about 0.85 inch. The blind guide work contact tip 10 has a preferred total height $H_T$ of between about ¼ inch and about ¾ inch, preferably between about 0.4 inch and about 0.7 inch, still more preferably about 0.6 inch. The body 18 also has a height $H_B$ of about 50% of the total height $H_T$ of the blind guide work contact tip 10. In addition, the body 18 can have a thickness $B_T$ of between about 0.25 inch and about 0.75 inch, preferably about 0.5 inch.

Figure 9:
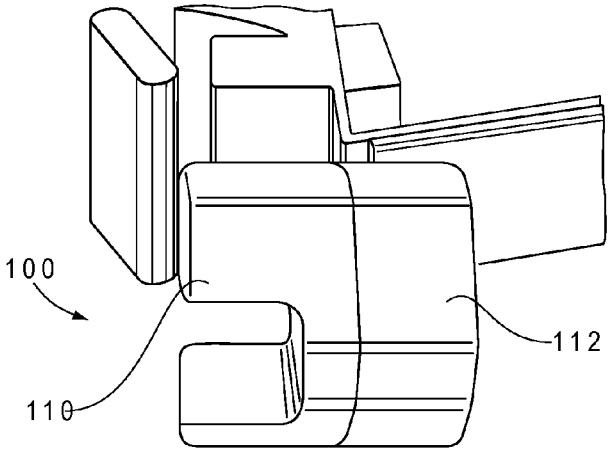
FIG. 9 is another perspective view, from the bottom, of another embodiment of the blind guide work contact tip.

In another embodiment as shown in FIG. 9, the angled blind guide work contact tip 100 is a two-piece fixture containing both a front 110 and back portion 112 which are attached around the existing drive probe. The front and back portions 110, 112 may be held together, for example, by a screw or adhesive.

Referring once again to FIGS. 1-8, as the final appearance of workpiece 1 is particularly important for finishing applications, such as fastening molding or trim, or face nailing on hardwood flooring, the blind guide work contact tip 10 preferably is made from a soft, resilient material so that when properly used there is little or no visibly noticeable impact mark or marring of suitable workpiece 1. The material should allow for a predetermined amount of friction sufficient to prevent slippage of blind guide work contact tip 10 when engaged with workpiece 1. Preferably, blind guide work contact tip 10 is made from rubber, or another highly resilient material. The material also should be selected so that blind guide work contact tip 10 is worn down by workpiece 1, and not the other way around, wherein workpiece 1 is worn away by blind guide work contact tip 10. The material of blind guide work contact tip 10 is preferably inexpensive and easily replaceable.

The blind guide work contact tip 10 of the present invention advantageously allows an operator of the fastening tool to easily locate and position the location where the fastener will be driven without marring the workpiece and by blind nailing. The resilient blind guide work contact tip 10 includes a pair of wings having contact surfaces, wherein the wings form a channel for the drive probe and the fastener, such that the channel allows an operator to visually locate where the fastener will be driven into the workpiece.

Figure 7:
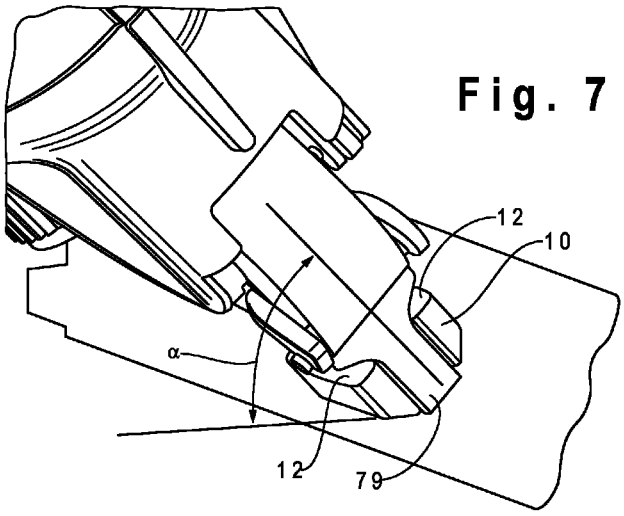
FIG. 7 is another perspective view, from the top of the blind guide work contact tip and the drive probe shown with respect to a workpiece.

Referring to FIG. 7-8, in hardwood flooring installation, the first few rows of flooring closest to the wall are typically installed using a finish nailer due to the close proximity to the wall and the large size of most hardwood flooring tools. In an example, the present blind guide work contact 10 allows for face nailing, as indicated at A, and blind nailing at the 45° angle, as indicated at B, between the tongue T of the board and the underlayment U. The angled blind guide work contact tip 10 is positioned such that the resilient sides 14 are positioned to rest on each of the surfaces forming the corner between the tongue T and the sides S of the floor board. One skilled in the art will appreciate that the present angled blind guide work contact tip 10 may be used with any type of corner in which fasteners are required and that the angle formed by the surfaces 14 may be increased and decreased 1-89 degrees depending on the requirements of the fastening application.

All patents referred to herein, are incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

We claim:

1. A fastening tool comprising:

a driver blade for driving a fastener into a workpiece;

a power source for driving the driver blade;

a housing enclosing the driver blade, the housing including a nosepiece for accepting the fastener and for axially guiding the driver blade in a driving direction toward impact with the fastener;

a wire drive probe extending in the driving direction from the housing to a driving end; and a resilient, blind guide work contact tip mounted to the driving end of the drive probe, the blind guide work contact tip having a body including ends, a front side, a rear side opposite the front side, a work contact surface having a flat surface and two angled surfaces, and a trailing surface opposite the work contact surface; and a pair of wings extending from the front side of the body at the ends, the pair of wings having resilient contact surfaces for contacting the workpiece, the wings forming a channel for the fastener while allowing for visually locating the position where the fastener will be driven into the workpiece.

2. The fastening tool according to claim 1, wherein the wings have ends and a predetermined length selected for positioning of the fastener at a predetermined distance from the ends of the wings.

3. The fastening tool according to claim 1, wherein the blind guide work contact tip further includes a recess in the trailing surface for retaining the drive probe and mounting the blind guide work contact tip to the drive probe, the recess being generally U-shaped.

4. The fastening tool according to claim 3 further comprising a detent in the recess to retain the drive probe in the recess.

5. The fastening tool according to claim 4, wherein the detent includes a ramp for allowing the drive probe to slide along the ramp into the recess, and wherein the recess includes ends adjacent the trailing surface, the ends having chamfers to allow the blind guide work contact tip to pivot in a side-to-side manner relative to the drive probe so that the fastening tool can be used when oriented other than completely vertically.

* * * * *